United States Patent [19]

Kirma

[11] Patent Number: 4,949,061

[45] Date of Patent: Aug. 14, 1990

[54] ELECTROMECHANICAL RELAY

[75] Inventor: Safa Kirma, Wedel/Holstein, Fed. Rep. of Germany

[73] Assignee: Messerschmitt-Boelkow-Blohm GmbH, Munich, Fed. Rep. of Germany

[21] Appl. No.: 376,613

[22] Filed: Jul. 7, 1989

[30] Foreign Application Priority Data

Jul. 8, 1988 [DE] Fed. Rep. of Germany ..... 3823186

[51] Int. Cl.[5] ..... H01H 61/06; H01H 37/46

[52] U.S. Cl. ..... 337/140; 337/393

[58] Field of Search ..... 337/140, 393

[56] References Cited

U.S. PATENT DOCUMENTS

| | | | |
|---|---|---|---|
| 3,594,674 | 7/1971 | Willson | 337/140 |
| 3,634,803 | 1/1972 | Willson et al. | 337/140 |
| 3,846,679 | 11/1974 | Jost et al. | 337/140 |
| 4,275,370 | 6/1981 | Sims | 337/140 |
| 4,524,343 | 6/1985 | Morgan et al. | 337/140 |
| 4,675,642 | 6/1987 | Reiferscheid | 337/140 |

*Primary Examiner*—H. Broome

*Attorney, Agent, or Firm*—W. G. Fasse; D. H. Kane, Jr.

[57] ABSTRACT

An electromechanical relay for the activation of at least one operating circuit, has an activator (10, 110) for example in the form of a helix made of a material having form-restoring or shape memory properties. A reset element (17, 117) holds the actuator in a distorted position opposite to that of its original position as long as an electrical heating current does not flow through the actuator. When the heating current, also referred to as switching current, is passing through the actuator, the latter returns to its original position or shape against the force of the reset spring thereby activating, through an operating member, a number of contact pairs of an operating circuit.

7 Claims, 3 Drawing Sheets

ELECTROMECHANICAL RELAY

CROSS-REFERENCE TO RELATED APPLICATIONS

The present invention relates to U.S. patent application No. 07/376,611 filed on 07/7, 1989; entitled: ELECTRICAL STRUCTURAL COMPONENT.

1. Field of the Invention

The invention relates to an electromechanical relay for the activation of at least one operating circuit through a mechanical operating member which opens or closes electrical spring contacts. The mechanical operating member is acted upon by an activating element or activator that is activated or energized by a switching current.

2. Background Information

Electromagnetic relays are well known in the art. In such relays the switching mechanism that is part of an operating circuit, is activated by means of a relay solenoid coil through which the switching current flows. Another type of relay is also known, in which the activating force used for operating the relay contacts is produced by mechanical means. This is the case, for example, in so-called thermal relays. There is room for improving such thermal relays.

OBJECTS OF THE INVENTION

In view of the above it is the aim of the invention to achieve the following objects singly or in combination:

to construct an electromechanical relay so that it has a high switching rating or power rating while simultaneously having a high reliability, and an optimally low structural expenditure;

to operate a relay by a spring type element which has a shape memory enabling it to resume a normal shape when the conditions for its normal shape are restored; and to construct such a relay as compact as possible.

SUMMARY OF THE INVENTION

This aim is achieved according to the invention by a relay in which an actuator element is made of a material with form-restoring properties, in other words the material has a shape memory, and in that a reset element having an effective or operating direction opposite to that of the activator element is arranged in a relay housing for cooperation with the activator element for operating relay contacts.

The material of the actuator, preferably comprises an alloy with a base of nickel and titanium, which has the property that after a mechanical deformation, it resumes its original form or shape when it is being heated. In the case of the relay according to the invention, the heating is achieved in that the switching current flows through the activator element.

The relay according to the invention has the advantage of an extremely high switching load cycle criterion or characteristic, specifically this relay can handle a large number of switching cycles without malfunction. In addition, the present relay also makes possible the simultaneous activation of a comparatively large number of contact pairs by means of only one operating member, respectively one activator element. As a result, the relay, according to the invention, brings about a distinct improvement in the ratio of weight to performance in comparison to customary electrical switching mechanisms of this type.

In the preferred example embodiment of the relay according to the invention, the activator comprises a spiral or rather helix configuration through which the switching current flows. One end of said spiral is rigidly connected to the relay housing in an electrically insulated manner and the other free end of the actuator acts on the operating member also in an electrically insulated manner so that the electrical heating or rather switching current may properly flow through the actuator helix.

Another advantageous feature of the invention is seen in that the resetting of the operating member to its starting position, when a switching current is not flowing, is simply accomplished by a reset spring acting in a direction opposite the deformation force of the activator element. However, it is also possible in the scope of the invention to install a second activator as a reset means. The second reset activator would also be made of a material having a form-restoring characteristic, but oppositely effective to produce the restoring force.

BRIEF DESCRIPTION OF THE DRAWINGS

In order that the invention may be clearly understood, it will now be described, by way of example, with reference to the accompanying drawings, wherein.

Figure 1:
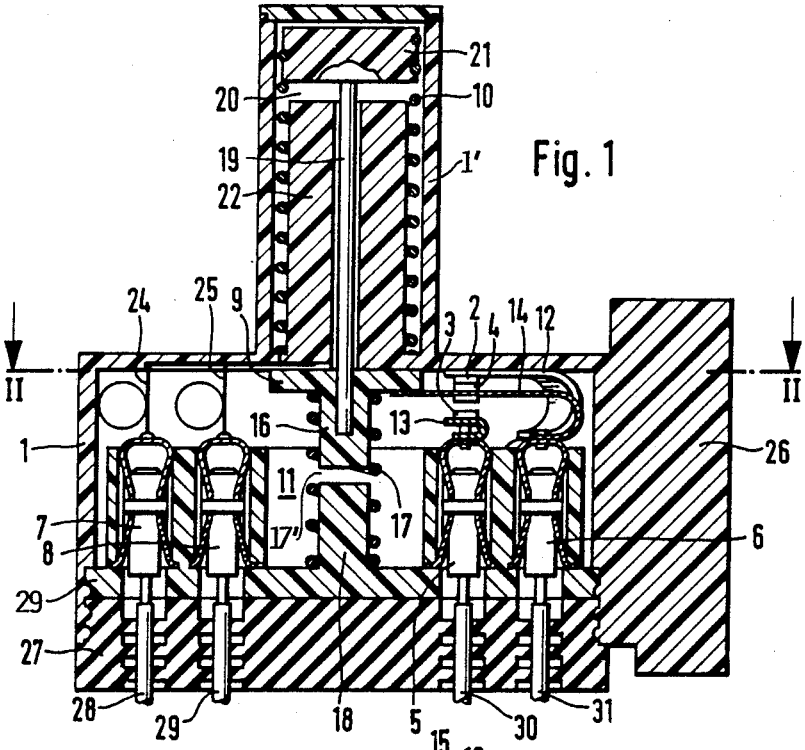
FIG. 1 is a vertical section through a switching relay according to the invention.

DETAILED DESCRIPTION OF PREFERRED EXAMPLE EMBODIMENTS AND OF THE BEST MODE OF THE INVENTION

In the figures, the same component parts are denoted with the same reference characters.

Figure 2:
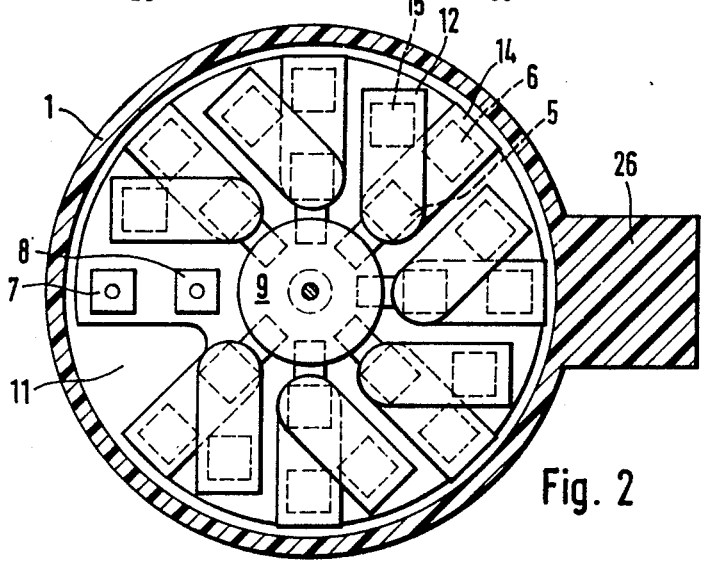
FIG. 2 shows a horizontal section according to section line II—II in FIG. 1.

In the relay of FIGS. 1 and 2, two sets of relay contact means are arranged concentrically in a relay housing 1. These relay contact means or terminals comprise, for example, two operating current terminals 5 and 6, two switching current terminals 7 and 8, an operating member 9, and an activator 10 arranged as shown. Switching contacts 2, 3, 4 respectively are combined as units arranged or distributed in a circular pattern in the lower chamber 11 of the housing 1. In the case of the preferred example embodiment there is a total of seven such units.

As can be seen especially in the illustration of FIGS. 1 and 2, the actual switching contacts 2, 3, 4 are connected with corresponding operating current terminals 5, 6, and 15 respectively by arc-shaped contact springs 12, 13, and 14. At least one of these arc-shaped contact springs 14 has an outer free end bearing against the operating member 9 under a certain biasing force. The operating member has the form of a stamp with a disk and a downwardly directed shaft 16 which is supported by a compression spring 17 acting as a reset means and bearing against the shaft 16. The compression spring 17 is supported on a cylindrical projection 18 on a base 27 of the lower chamber 11 in the housing 1. The base 29 forms a connector mounting plate which also closes the housing. The shaft 16 and projection 18 are spaced from each other at 17' to limit a downward stroke of the operating member 9.

A rod 19 is rigidly inserted into the shaft 16 of the operating member 9. The rod 19 extends into the upper chamber 20 of the housing 1 and carries a piston 21 at its upper end. The rod 19 is supported in a cylindrical guide member 22, which may comprise an integral part of the housing 1. The activator 10, which has the shape of a spiral or rather helix and which is made of a form-restoring shape-memory material, in this case an alloy of titanium and nickel, rests on the outer surface of this guide member 22. The housing extension 1' holding the guide member 22, and the piston 21 are made of an electrically insulating material so that an electrical potential may be applied to the actuator helix 10 to pass an electrical heating current through the helix. Thus, the activator or helix 10 is connected through the electrical conductors 24, 25 and through a return conductor not depicted in the drawing, to the switching current terminals 7 and 8. The return conductor is preferably also wound as the helix to facilitate its movement with the actuator 10. The lower end of the actuator 10 is fastened to the bottom of the upper chamber 20 of the housing portion 1', while the other free end of the actuator helix 10 is connected with the piston 21 in a force transmitting manner.

The arrangement is completed by a mounting member 26 laterally fixed to the housing 1, which enables the relay to be inserted into or onto a shift rail not depicted in the drawing, and by an elastic rubber socket or cover 27 secured to the base of the housing 1. The socket or cover 27 has corresponding bores for the electrical conductors 28, 29, 30 and 31 leading to the switching and operating current terminals.

Figure 3:
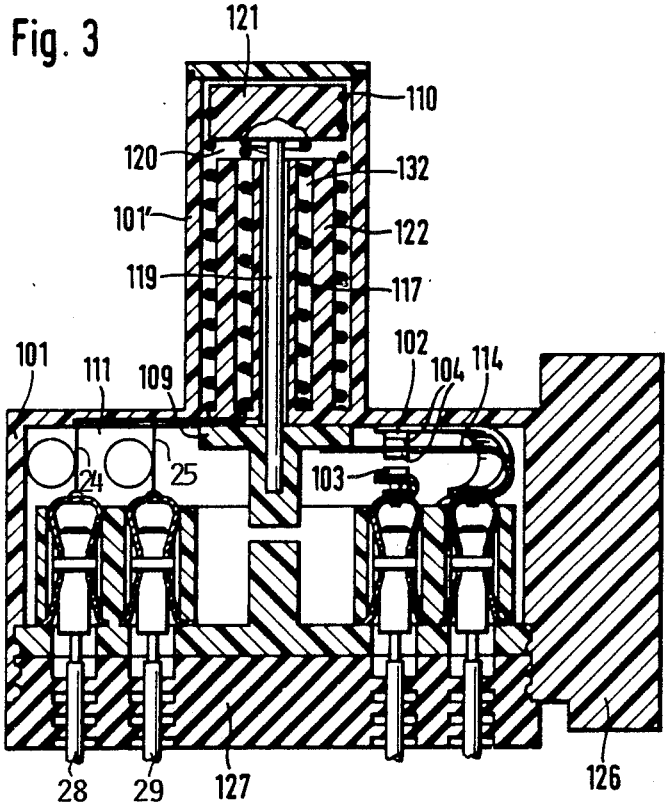
FIG. 3 is a vertical section through a second relay embodiment of the invention.

The second relay in FIG. 3 differs from the aforementioned arrangement in that, in FIG. 3 the reset spring 117 is arranged coaxially to the spiral-shaped activator 110 in the upper chamber 120 of a housing section 101' forming part of the housing 101. The reset spring 117 is constructed as a compression spring, the upper end of which bears against the base of the piston 121. A cylindrical recess 132 in a guide member 122 is provided for the mounting of the reset spring 117, the lower end of which is supported by the base of said recess 132. As further depicted in the drawing, the reset spring 117 also serves as a conductor for the return movement of the switching current that flows through the actuator helix 110.

The outer form of the housing 101 with its extension 101' and with the mounting member 126 and the interior of the lower chamber 111 are constructed identically to the described arrangement of FIGS. 1 and 2, with the exception of the compression spring 17 acting upon the operating member 109. There is no reset spring 17 in FIG. 3. However, the reset spring 117 performs the same function as the spring 17. Consequently, the following described operating sequence is identical in both relays.

Activation of the relay results when an electrical current passes through the switching current conductors 28, 29, the contact pins 7, 8, the conductors 24, 25, and through the actuator helix 10, 110. In FIGS. 1 and 3, this actuator helix 10, 110 is depicted in a position opposite its original position or configuration, that is a configuration set at the time of construction. More specifically, the helix is lengthened by the force of the compression spring 17 or 117. The switching current heats the actuator helix 10, 110, causing said spiral to take on its original, controlled shape. The piston 21 or 121 is thereby moved against the force of the reset spring 17 or 117, and the operating member 9 or 109, is moved by the rod 19 or 119, in the downward direction toward the connector mounting 27 or 127. Further downward movement is stopped when the shaft 16 abuts against the projection 18.

Through this movement, the operating member 9 or 109, takes with it the contact springs 14 or 114, thereby separating the contact pairs 2 and 4 or 102 and 104, subsequently bringing the contacts 4 or 104 into connection with the contacts 3 or 103. This switching position is maintained until, through an interruption of the switching current, the form-restoring material of the activating element 10 or 110, gives way enough so that the force of the reset spring 17 or 117 can take over and the arrangement is returned to its starting position as depicted in FIGS. 1 and 3.

A metal alloy having a shape memory comprises, for example, 55.1 wt. % of nickel, and 44.9 wt. % of titanium.

Figure 4:
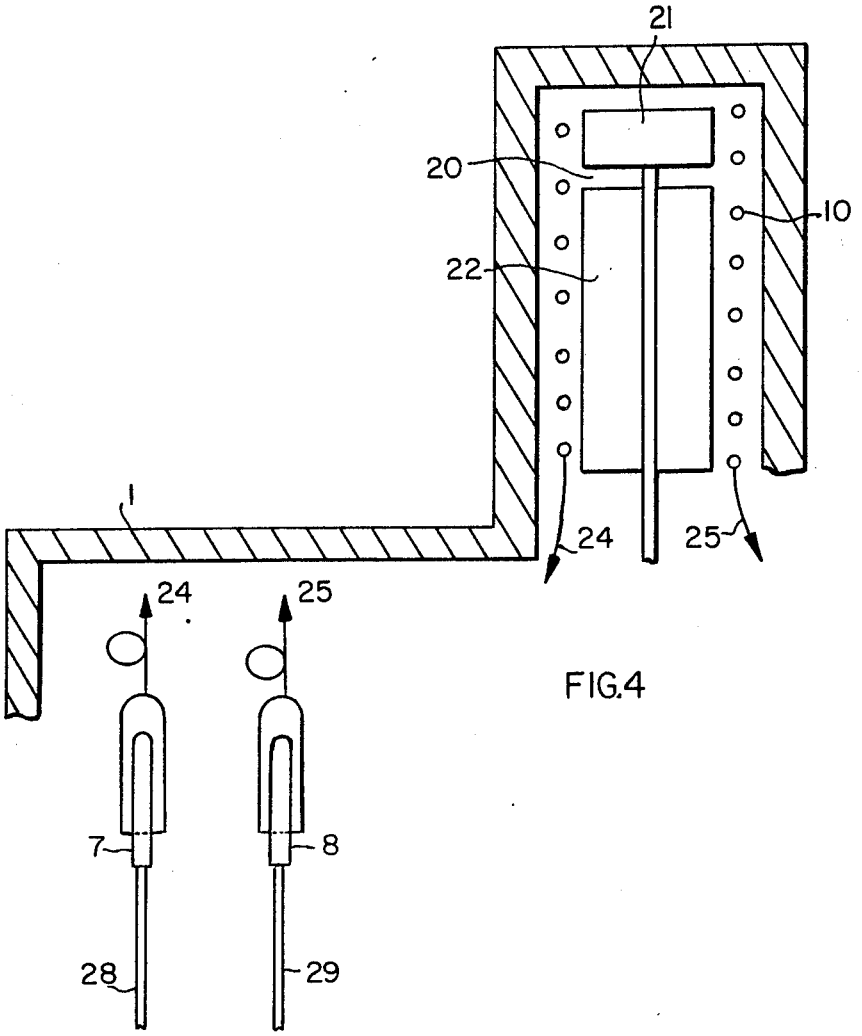
FIG. 4 illustrates, on an enlarged scale compared to FIG. 1, the connection of an actuator to a switching signal input.

FIG. 4 shows how the conductors 24, 25 are connected to the ends of the element 10. Both ends are located at the lower end of the wound up element. The same also applies in principle to FIG. 3.

Although the invention has been described with reference to specific example embodiments it will be appreciated that it is intended to cover all modifications and equivalents within the scope of the appended claims.

I claim:

1. An electromechanical relay, comprising housing means, electrical spring contact means in said housing means for activating at least one operating circuit, a mechanical operating member in said housing means for operating said spring contact means for opening or closing a respective operating circuit, said operating member comprising a disk, a connecting rod, and a guide piston connected to said disk by said rod, said housing including a section in which said guide piston is guided, said relay including an actuator in said housing means for moving said operating member in response to a switching current applied to said actuator of said relay means, said actuator being made of a material having a shape memory characteristic for returning into a normal shape after a change in said normal shape, and reset means arranged for cooperation with said actuator, said reset means having an effective operating direction opposite to an operating direction of said actuator for assisting said actuator in returning to said normal shape.

2. The electromechanical relay of claim 1, wherein said actuator (10, 110) of said relay is constructed as a helix, one end of said helix being effective on said operating member in a force transmitting manner, the other end of said helix being operatively fixed to said housing means, and means for applying an operating electrical current to said actuator.

3. The electromechanical relay of claim 1, wherein said material of said actuator is a titanium base alloy.

4. The electromechanical relay of claim 1, wherein said reset means are constructed as a compression spring.

5. The electromechanical relay of claim 1, wherein said material of said actuator is a nickel base alloy.

6. The electromechanical relay of claim 1, wherein said reset means comprise a reset spring bearing against said operating member, said housing means including a connector mounting plate forming a closure of said housing means, said reset spring also bearing against said closure.

7. The electromechanical relay of claim 1, wherein said actuator is constructed as a first helix, wherein said reset means is constructed as a second helix, said first and second helix being arranged concentrically to each other in said housing means, and wherein said first helix and said second helix are operatively connected to said guide piston of said operating member.

* * * * *